US005505418A

United States Patent [19]

Corcoran

[11] Patent Number: 5,505,418

[45] Date of Patent: Apr. 9, 1996

[54] DUAL ADJUSTMENT BLIND AND SHADE SUPPORT

[75] Inventor: Kevin J. Corcoran, Windham, N.H.

[73] Assignee: Granite State Innovations, Inc., Windham, N.H.

[21] Appl. No.: 381,019

[22] Filed: Jan. 31, 1995

Related U.S. Application Data

[63] Continuation of Ser. No. 153,764, Nov. 17, 1993, abandoned, which is a continuation-in-part of Ser. No. 72,173, Jun. 3, 1993, abandoned.

[51] Int. Cl.[6] ..... A47H 1/14

[52] U.S. Cl. ..... 248/254; 160/89; 160/178.1; 160/902; 160/903; 248/257

[58] Field of Search ..... 160/89, 108, 173 R, 160/178.1 R, 902, 903; 248/251, 252, 253, 257, 261, 262, 265, 266, 267, 268, 269, 201

[56] References Cited

U.S. PATENT DOCUMENTS

| | | | |
|---|---|---|---|
| 629,323 | 7/1899 | Dilts . | |
| 751,800 | 2/1904 | Mallory . | |
| 807,015 | 12/1905 | Burlingham | 248/252 |
| 905,949 | 12/1908 | Stuck et al. | 248/252 |
| 1,248,320 | 11/1917 | Hamilton . | |
| 1,501,843 | 7/1924 | Durnell et al. . | |
| 2,027,280 | 1/1936 | Lindemann | 160/902 X |
| 2,253,584 | 8/1941 | Robinson | 248/252 |
| 2,569,063 | 9/1951 | Koegler et al. | 248/264 |
| 2,579,788 | 12/1951 | Burns . | |
| 2,594,655 | 4/1952 | Junkunc | 248/252 X |
| 3,907,240 | 9/1975 | Belli . | |
| 4,724,885 | 2/1988 | Chang . | |
| 4,840,216 | 6/1989 | John . | |
| 5,205,334 | 4/1993 | Judkins | 160/108 X |
| 5,265,837 | 11/1993 | Marocco | 160/902 X |

FOREIGN PATENT DOCUMENTS

| | | |
|---|---|---|
| 1601619 | 9/1970 | France . |
| 6610954 | 2/1968 | Netherlands . |
| 1042800 | 9/1966 | United Kingdom . |

OTHER PUBLICATIONS

International Search Report.

*Primary Examiner*—Alvin C. Chin-Shue
*Assistant Examiner*—Derek J. Berger
*Attorney, Agent, or Firm*—Hamilton, Brook, Smith & Reynolds

[57] ABSTRACT

A combination venetian blind and roller shade support comprising a pair of mirror-image combination brackets. Each bracket has a pair of discrete compartments, one compartment to receive one end of a venetial blind and the other compartment containing support mechanism for a roller shade bracket. The support mechanism is adjustable to vary the location of the roller shade bracket relative to the combination bracket to accommodate roller shades of different widths.

15 Claims, 5 Drawing Sheets

40
2
50
5
53
52
41
7
6

DUAL ADJUSTMENT BLIND AND SHADE SUPPORT

This application is a continuation of application Ser. No. 08/153,764 filed Nov. 17, 1993, now abandoned, which is a continuation-in-part of U.S. patent application Ser. No. 08/072,173 filed Jun. 3, 1993, now abandoned.

BACKGROUND OF THE INVENTION

All window treatments are designed for three major functions: the control of light, energy efficiency and the aesthetic effect of room decor. There are two basic types of window shades which are light filtering and room darkening. Light filtering window shades are made of translucent materials that allow some light to enter the room and offer some privacy, while room darkening window shades are made from opaque materials and offer complete room darkening characteristics. The room darkening window shade remains the best window treatment for sleeping areas or where complete privacy is desired.

One of the major problems with the window shade is that, as a single source of light control, the user is limited to the type of window shade that is installed. Light filtering shades are not good in areas where darkening of the room is desired and room darkening shades cannot offer good partial light control.

Another major problem is that the window shade is not normally looked at as a decorative window treatment. Manufacturers of the more fashionable venetian blinds, mini blinds, and all types of pleated shades have tried to introduce room darkening variations of their products with little success. The basic construction of venetian blinds and pleated shades is such that they require holes for the operating cords and these holes allow light to pass through. Furthermore, the venetian blind slats, while attempts have been made to redesign their configuration, also let light pass through where the slats overlap when in the closed position.

Window shades are unsurpassed in their ability to control the loss of heating or cooling energy. The cloth or vinyl material used to make window shades provide a solid energy barrier while venetian blinds and pleated shades, because of the openings in their construction, are less effective in this area.

Window shades, venetian blinds, mini blinds and pleated shades are manufactured both by custom fabrication (made to fit a specific consumer's window) or in standard stock sizes. The stock venetian and mini blind products are stocked by the retailer in most sizes from 23 inches through 36 inches, or longer, every inch on the inch. The design of these products allows them to fit windows within a range of approximately ¾ inch from the size purchased.

For example, a 29 inch stock sized mini blind will fit a window opening from 28¾ inches to 29½ inches, the mounting bracket allows for this adjustably. This allows the consumer to buy a standard size and adjust the product when it is installed in the window. Window shades are normally stocked by the retailer in only three or four sizes and are cut to the consumer's exact dimensions, using a special machine, at the time of purchase.

While it is apparent that the combination of the window shade and venetian blinds or pleated shades would provide the ultimate window treatment, the construction of most windows make it difficult or impossible to install two separate bracketing systems which would allow the combination of the decorative treatment and the functionality of the roller window shade.

SUMMARY OF THE INVENTION

The primary object of the present invention is to provide a functional device which will allow for the easy installation of a venetian blind, mini blind, or a pleated shade in combination with a conventional roller window shade, with or without, customized cutting of either of the installed window treatments.

In particular, it is an object of the present invention to provide a pair of brackets (left-hand and right-hand) which accommodate the installation of a customized or stock sized venetian blind, mini blind or pleated shade and a stock sized roller window shade in a single mounting system which allows for mounting width adjustably of each product independently. While the window shade behind the venetian blind is the focus of the present invention, the two types of window treatments can be reversed with slight modification of the combination bracket at the time of manufacture.

A feature of the present invention resides in the combination bracket which accommodates the width variations of the roller window shade by use of sliding bracket portion. The sliding bracket easy lock in their proper position.

Another feature of the present invention resides in the use of a spring activated window shade bracket which automatically centers the window shade between the mounted brackets so the window shade portion of the bracket can then be secured by the user. The spring activated centering device can be removed easily by the consumer for additional width adjustment or if manual adjustment is desired.

Specifically, there is disclosed a combination venetian blind and roller shade support comprising a pair of mirror-image combination brackets. Each bracket has a front or first compartment to receive one end of a venetian blind and a rear or second compartment containing support mechanism for a roller shade bracket. The support mechanism is adjustable to vary the location of the roller shade bracket relative to the combination bracket to accommodate roller shades of different widths. There is a door in each of the front compartments to retain a venetian blind in the combination brackets. A spring may be employed to bias at least one of the roller shade brackets to accommodate roller shades of differing widths. The adjusting mechanism for the roller shade brackets include a slot and screw mechanism.

The focus of the drawings show the positioning of the window shade in the rear of the venetian blind. Reversing the two window treatments, i.e., to have the window shade in the front and the venetian blind to the rear, is within the scope of the invention and is easily accomplished at the time the combination bracket is manufactured.

In accordance with another feature of the invention, a pleated shade may be located in the first compartment and a venetian blind or a roller shade may be located in the second compartment.

In accordance with another feature of the invention, the roller shade supporting mechanism may be located in the first compartment and either a pleated shade or venetian blind may be located in the second compartment.

In accordance with yet another feature of the invention, the door of the first comparment may be provided with a clip for supporting a valance or the like.

The above and other features of the invention including various and novel details of construction and combination of parts will now be more particularly described with reference to the accompanying drawings and pointed out in the claims. It will be understood that the particular dual adjustment blind and shade support embodying the invention is shown by way of illustration only and not as a limitation of the invention. The principles and features of this invention may be employed in varied and numerous embodiments without departing from the scope of the invention.

DETAILED DESCRIPTION OF THE INVENTION

Figure 1:
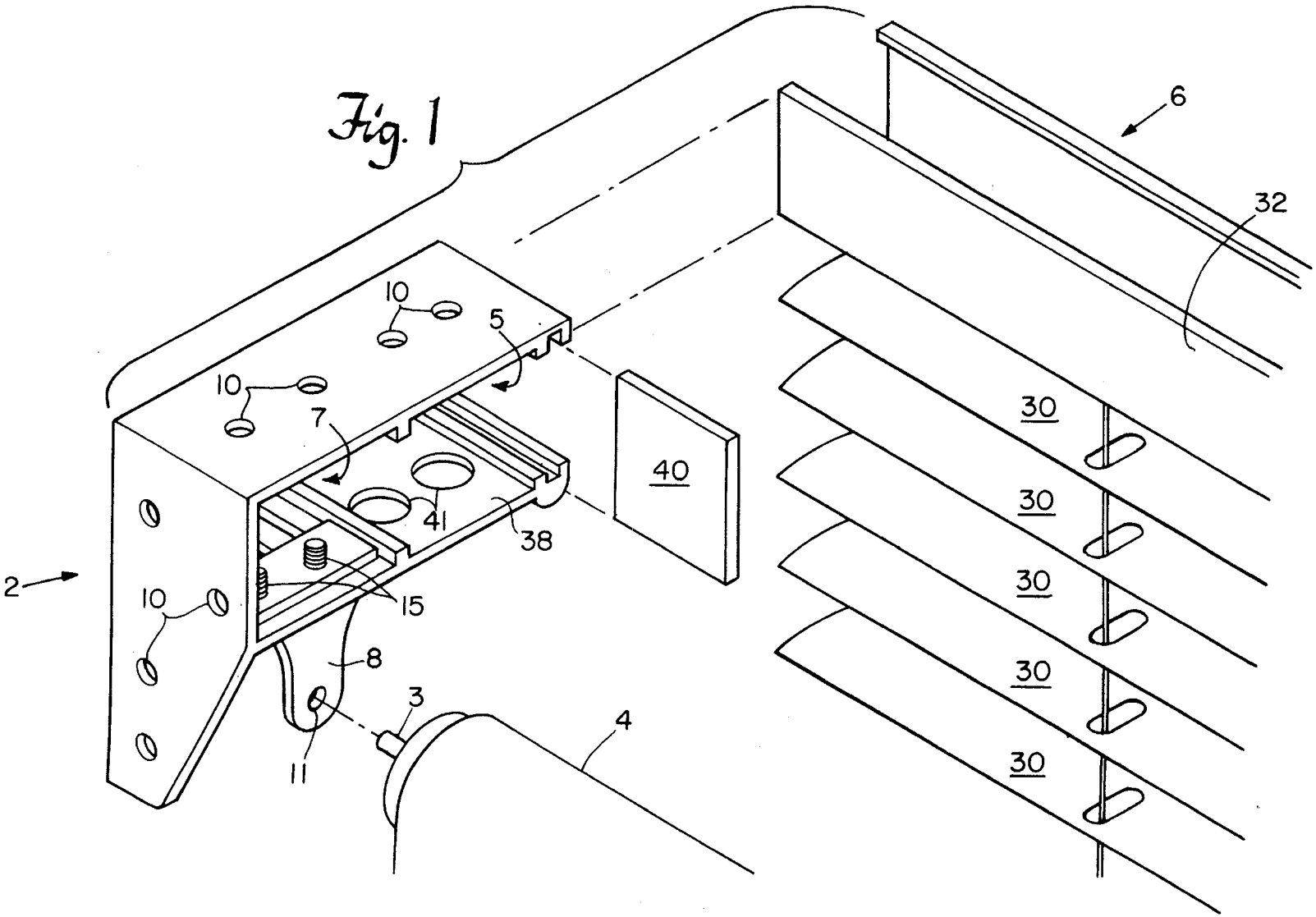
FIG. 1 is an exploded perspective view of one of a pair of brackets embodying the invention in combination with a venetian blind and roller window shade viewed from the rear.
Figure 2:
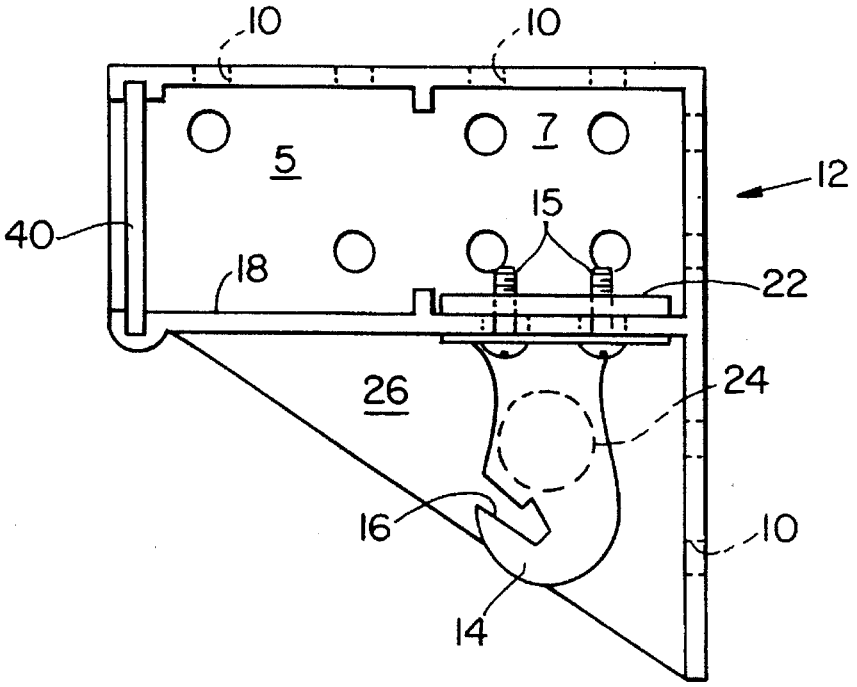
FIG. 2 is a side view of a left hand assembled bracket showing mounting holes and the mounting location of the front window treatment and the roller window shade bracket.
Figure 3:
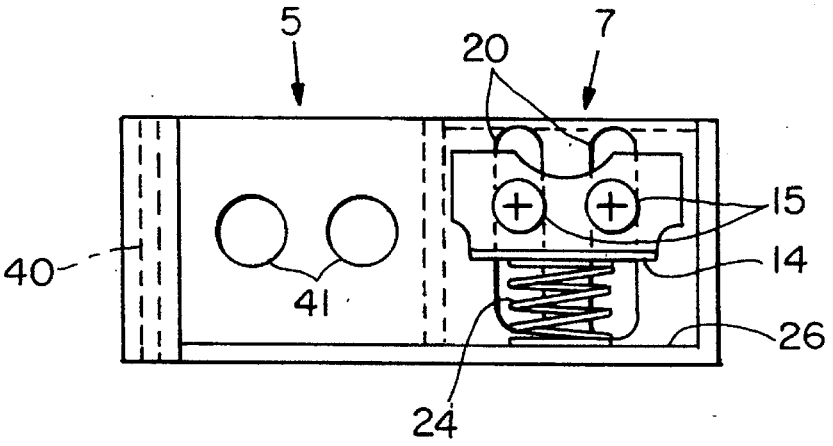
FIG. 3 is a bottom view of the bracket of FIG. 2 showing a spring activated centering mechanism of the bracket and slotted bracket slide.

The invention is embodied in a combination venetian blind and roller shade support which comprises a pair of mirror image brackets. As will be obvious from FIGS. 2 through 6, each bracket is substantially rectangular in cross-section and includes a top 9 and a bottom or floor 18. Right-hand combination bracket generally indicated 2 will be seen in FIG. 1 as viewed from the rear, or from a window looking into a room. Each bracket has two compartments, a front compartment 5 and a rear compartment 7. As will be seen in the Figs., the compartments are in side-by-side horizontal relationship. The front compartment receives one end of a venetian blind and the rear compartment includes structures for mounting a roller shade bracket. The pin 3 of a window shade generally indicated 4 and a venetian blind generally indicated 6 are shown before installation. A right-hand shade bracket or holder 8 is shown in its location behind the venetian blind 6 depending from and supported within the rear compartment 7. Ample mounting holes 10 are provided to allow the combination bracket 2 to be mounted inside or outside a window or for ceiling mounted installation. As seen in FIGS. 2, 3 and 5, a wall 17 on the brackets 2 and 12 extend the top 9 and the bottom 18 and forms an end closure of the bracket.

FIG. 2 shows the left-hand bracket 12. Like parts of each of the left and right hand brackets will have the same reference characters. A motor-end bracket 14 includes a notch 16 to receive the conventional tang (not shown) at the motor end of the shade. The shade bracket 14 receives two threaded screws 15. They pass through holes in the shade bracket 14 (or the shade bracket 8 in the right hand combination bracket 2), through the floor 18 of the bracket and into the rear compartment 7 of the bracket 12. They pass through slots 20 and are threaded into a locking strap 22 which is positioned in the rear compartment 7 on the floor 18. Turning the screws 15 clockwise secures the shade bracket 14 in place.

A spring 24 is compressed between a vertical wall 26 and the bracket 14 to urge the bracket away from the wall 26 when the screws 15 are loosened to accommodate a shade of shorter length. Either or both the left hand shade bracket 8 or the right hand bracket 14 may be spring based.

Referring again to FIG. 1, the venetian blind 6 having slats 30 depending from a conventional housing 32 (FIG. 1). The housing 32 slides into the front portion 38 of the combination brackets 2 and 12 and is secured therein by sliding front bracket doors 40. Holes 41 in the floor of the front portion 38 accommodate conventional chain and cord controls.

With the screws 15 loosened, the window shade 4 is inserted into the shade brackets 8 and 15 of the combination brackets 2 and 12, respectively. As seen in FIG. 3, the spring 24 will keep the brackets 8 and/or 14 in the most closed position until the window shade is installed by using slight inward pressure. The motor tang (not shown) of the shade enters the slot 16 in the bracket 14 and the pin 3 (FIG. 1) enters a hole 11 in the bracket 8. The screws 15 are then tightened.

The consumer installs the product by securing the right and left brackets 2 and 12 in the respective corners of the window. The window shade 4 is inserted into the shade brackets 8 and 14 by first inserting the pin 3 of the window shade roller into the hole 11, pushing the bracket back against the force of the spring 24 and then inserting the motor end tang (not shown) of the shade into the slot 16. Spring action will center the shade between the brackets 8 and 14. The spring 24 can be removed if additional width adjustment is required.

The venetian blind 30 or pleated shade is then inserted into the front of the combination brackets 2 and 12 and the bracket doors 40 are moved into place to secure the blind. The consumer operates the window shade by raising the front window treatment, i.e., venetian blind or pleated shade, and operating the window shade manually in conventional manner.

Figure 4:
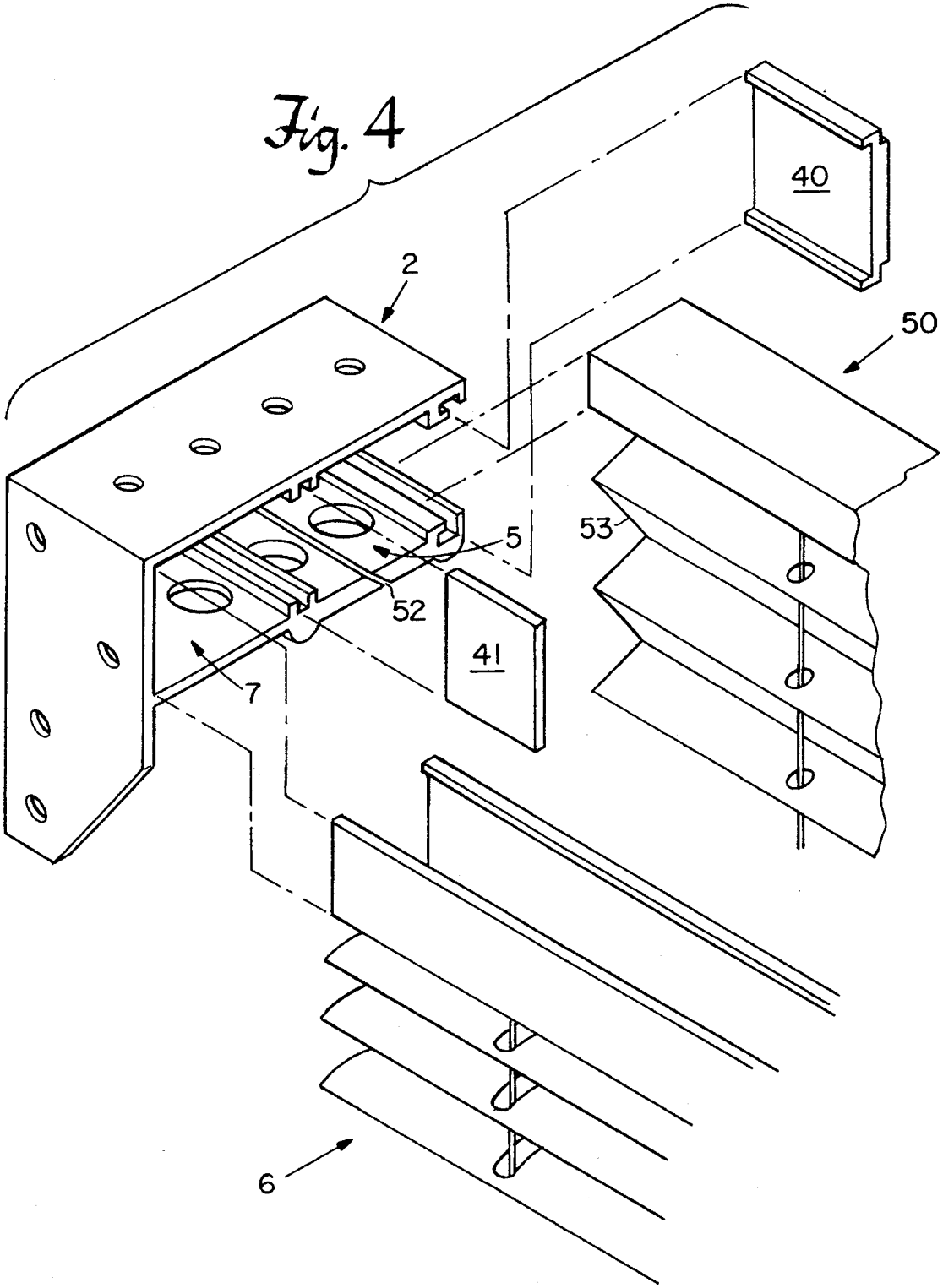
FIG. 4 is an exploded perspective view of one of a pair of brackets embodying an alternative embodiment of the invention in combination with a venetian blind and pleated shade.
Figure 6:
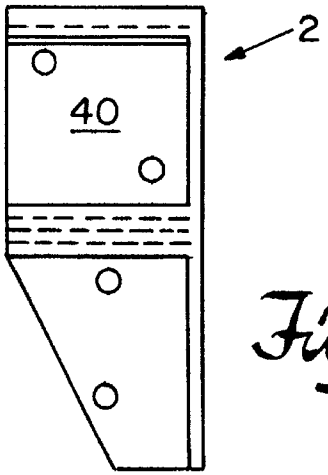
FIG. 6 is a front view of the bracket shown in FIG. 5.
Figure 5:
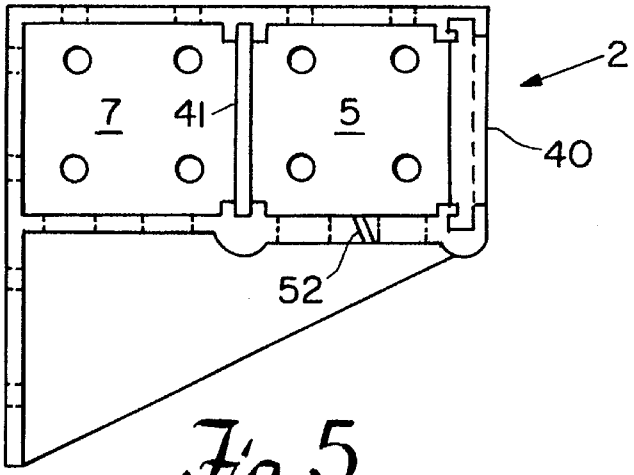
FIG. 5 is a side view of a right hand assembled bracket for accommodating a venetian blind and a pleated shade.
Figure 7:
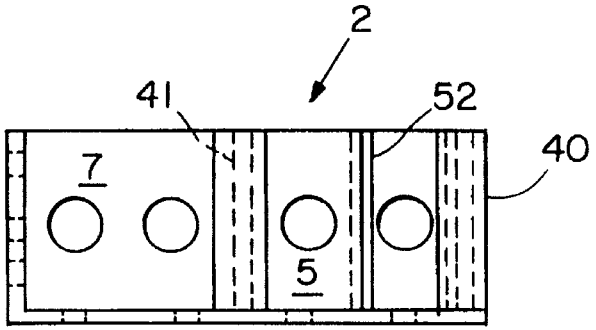
FIG. 7 is a bottom view of the bracket of FIG. 5.

A second embodiment of the invention will be seen in FIGS. 4–7. FIG. 4 shows a right hand combination bracket generally indicated 2 which is adapted to accommodate a mini-blind 6 in the rear compartment and a pleated bracket 50 in the front compartment 5. It is the reverse of the FIG. 1 embodiment where the mini-blind 6 is accommodated in the front compartment 5. A bracket door 40 closes the compartment 5 and a second sliding door 41 separates compartments 5 and 7 to retain the mini-blind and the pleated shade in their respective positions.

The bottom of the forward compartment 5 is provided with an inclined slot 52. Upon assembly, when the pleated shade 50 is inserted into the front compartment 5, the diagonal panel 53 is slid into the slot 52 and the remaining panels depend from the bracket.

Figure 8:
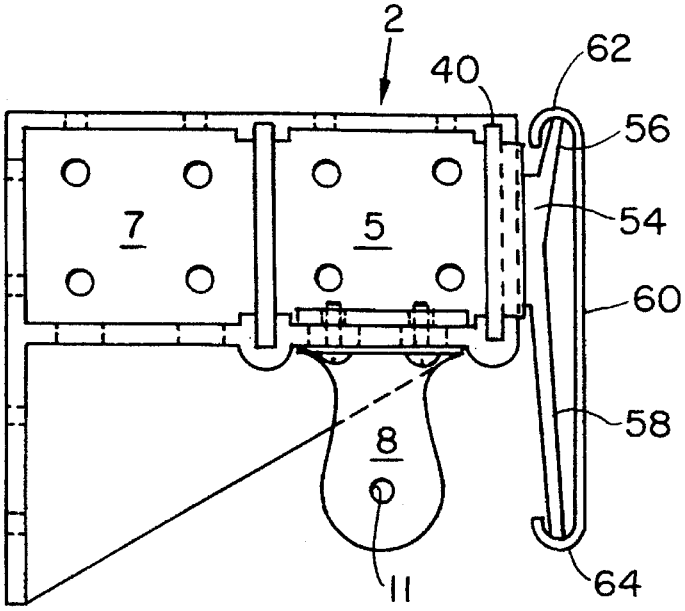
FIG. 8 is a side view of a right hand assembled bracket having a integral clip to hold a valance and in which the roller shade is located in the first compartment in which the second compartment is adapted to mount a mini-blind.
Figure 9:
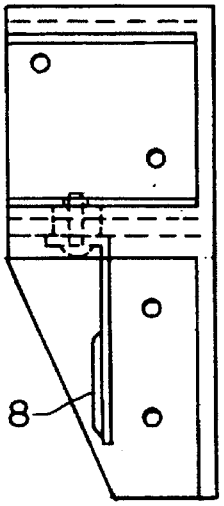
FIG. 9 is a front view of the bracket shown in FIG. 8.
Figure 10:
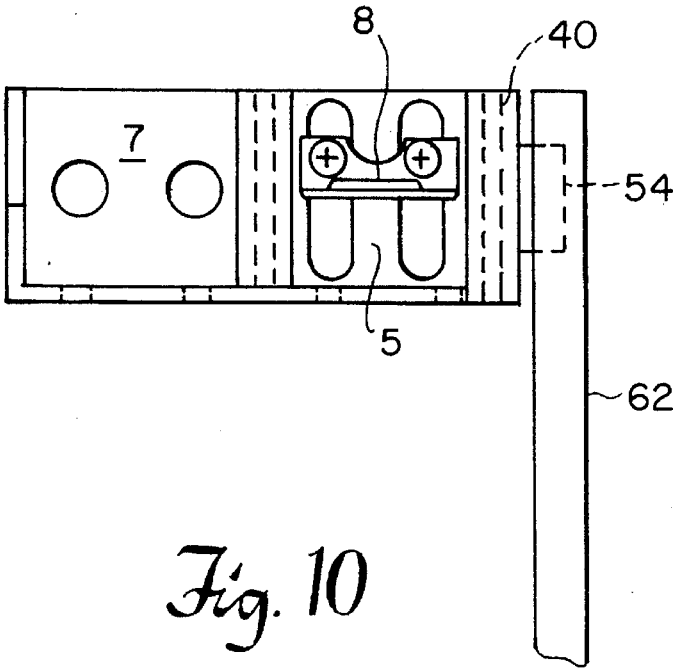
FIG. 10 is a bottom view thereof.

An additional embodiment is shown in FIGS. 8, 9 and 10. Whereas the FIG. 1 embodiment shows the roller shade bracket holder 8 in its location behind the venetian blind 6 depending from and supported within the rear compartment 7, it may be alternatively located in the front compartment 5 and the mini-blind 6 located in the rear compartment 7 or if desired the pleated shade 50 may be located in the rear compartment 7 by appropriately slotting the bottom of the bracket as at 52 (FIG. 4).

Another embodiment will be seen in FIGS. 8 and 10. The door 40 mounts a bracket 54 having a short upwardly projecting arm 56 and a longer downwardly projecting arm 58 to mount a valance 60. The valance has curved ends 62 and 64 which are slid over the arms 56 and 58 respectively of the clip 54. The valance may be appropriately colored or cloth covered for asthetic purposes.

What is claimed is:

1. A combination venetian blind and roller shade support for installation adjacent a window comprising:

a pair of mirror-image, combination brackets, each bracket being substantially rectangular in cross section and including a top and a bottom, a pair of discrete compartments in each bracket in side-by-side, horizontal, relationship located between the top and the bottom, a wall on each bracket extending between the top and the bottom forming an end closure of one of said compartments and a removable door forming the end of the other compartment, a roller shade support bracket depending from the bottom of one of said compartments in both of the combination brackets of the pair, and the other of said compartments in each combination bracket of the pair being adapted to receive the ends of a venetian blind.

2. A combination support in accordance with claim 1 wherein a plurality of holes are located in each bracket to permit mounting the bracket inside a window or on a ceiling.

3. A combination support in accordance with claim 1 wherein a spring biases at least one of the roller shade brackets to accommodate roller shades of differing widths.

4. A combination support in accordance with claim 1 wherein adjusting mechanism is located in the compartment above the roller shade bracket to vary the location of said shade bracket relative to the combination bracket in accordance with the width of the roller shade.

5. A combination support in accordance with claim 4 wherein the adjusting mechanism includes a slot and screw connection.

6. A combination venetian blind and roller shade support for installation adjacent a window comprising:

a pair of mirror-image, combination brackets;

each bracket being substantially rectangular in cross section and including a top and a bottom, a pair of discrete compartments in each bracket in side-by-side, horizontal, relationship located between the top and the bottom, a wall on each bracket extending between the top and the bottom forming an end closure of one of said compartments and a removable door forming the end of the other compartment, a roller shade support bracket depending from the bottom of the compartment having the wall end closure in both of the combination brackets of the pair, the other of said compartment in each combination bracket of the pair being adapted to receive the ends of a venetian blind.

7. A combination support in accordance with claim 6 wherein a plurality of holes are located in each bracket to permit mounting the bracket inside a window or on a ceiling.

8. A combination support in accordance with claim 6 wherein a spring biases at least one of the roller shade brackets to accommodate roller shades of differing widths.

9. A combination support in accordance with claim 6 wherein adjusting mechanism is located in the compartment above the roller shade bracket to vary the location of said shade bracket relative to the combination bracket in accordance with the width of the roller shade.

10. A combination support in accordance with claim 9 wherein the adjusting mechanism includes a slot and screw connection.

11. A combination venetian blind and roller shade support for installation adjacent a window comprising:

a pair of mirror-image, combination brackets, each bracket being substantially rectangular in cross section and including a top and a bottom, a pair of discrete compartments in each bracket in side-by-side, horizontal, relationship located between the top and the bottom, a wall on each bracket extending between the top and the bottom forming an end closure of one of said compartments and a removable door forming the end of the other compartment, a roller shade support bracket depending from the bottom of the compartment having the removable door in both of the combination brackets of the pair, the other of said compartments in each combination bracket of the pair being adapted to receive the ends of a venetian blind.

12. A combination support in accordance with claim 11 wherein a plurality of holes are located in each bracket to permit mounting the bracket inside a window or on a ceiling.

13. A combination support in accordance with claim 11 wherein a spring biases at least one of the roller shade brackets to accommodate roller shades of differing widths.

14. A combination support in accordance with claim 11 wherein adjusting mechanism is located in the compartment above the roller shade bracket to vary the location of said shade bracket relative to the combination bracket in accordance with the width of the roller shade.

15. A combination support in accordance with claim 14 wherein the adjusting mechanism includes a slot and screw connection.

* * * * *